US007095305B2

(12) United States Patent
Shiao

(10) Patent No.: US 7,095,305 B2
(45) Date of Patent: Aug. 22, 2006

(54) RETRACTABLE MAGNETIC SWEEPER

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 174 days.

(21) Appl. No.: 10/754,353

(22) Filed: Jan. 11, 2004

(65) Prior Publication Data

US 2005/0151611 A1 Jul. 14, 2005

(51) Int. Cl.
*H01F 7/20* (2006.01)

(52) U.S. Cl. ..... 335/289; 335/291; 209/226

(58) Field of Classification Search ..... 335/285, 335/291; 209/213–215, 226, 228, 614
See application file for complete search history.

(56) References Cited

U.S. PATENT DOCUMENTS 2,426,795 A * 9/1947 Sjostrom ..... 209/215
2,970,003 A * 1/1961 Heath, Jr. et al. ..... 294/65.5
3,377,641 A * 4/1968 McGregor ..... 15/105
3,693,279 A * 9/1972 Mackie ..... 43/42.06
5,413,225 A * 5/1995 Shields ..... 209/614
5,868,258 A * 2/1999 Hubbard, Jr. ..... 209/215

* cited by examiner

*Primary Examiner*—Lincoln Donovan
(74) *Attorney, Agent, or Firm*—Trop, Pruner & Hu, P.C.

(57) ABSTRACT

A retractable magnetic sweeper includes a shell member, a retractable tubular member, a moving member, a connecting bar member, and a magnetic member. The shell member defines a receiving space. The retractable tubular member includes a lower tubular section connected to the shell member, and an upper tubular section mounted slidably on the lower tubular section. The moving member is mounted on the upper tubular section. The connecting bar member is mounted axially within the retractable tubular member, and includes an operating end portion extending into the upper tubular section and connected to the moving member, and a connecting end portion extending into the lower tubular section. The magnetic member is mounted in the receiving space, and is connected to the connecting end portion. The moving member is operable to move the magnetic member downward to an operative state, and upward to a non-operative state.

17 Claims, 15 Drawing Sheets

RETRACTABLE MAGNETIC SWEEPER

BACKGROUND OF THE INVENTION

1. Field of the Invention

The invention relates to a magnetic sweeper, more particularly to a retractable magnetic sweeper.

2. Description of the Related Art

Magnetic metal objects, such as nails, nuts, screws, springs, studs, clips, etc., are likely to drop to the floor when in use. In a clean and small space, they can be picked up with bare hands with relative ease. However, it is troublesome to remove such metal objects from a spacious area, such as a yard, a lawn, a work site, and the beach, or small and narrow spaces, such as the ground beneath a car's chassis.

There is available a type of magnetic sweeper, such as that shown in FIG. 1, for removing magnetic metal objects from a surface. The magnetic sweeper as shown in FIG. 1 includes a base seat 1, a tubular member 2 connected to and extending from the base seat 1, a handle 3 connected to the tubular member 2 opposite to the base seat 1, a magnetic member 4 mounted within the base seat 1, a pulling bar 5 mounted axially within the tubular member 2 and connected to the magnetic member 4, and a moving member 6 connected to the pulling bar 5 opposite to the magnetic member 4 and surrounded by the handle 3. When the moving member 6 is not pulled, the magnetic member 4 abuts against a bottom wall 101 of the base seat 1. Therefore, the magnetic sweeper can be operated by holding the handle 3 to attract the magnetic metal objects onto the bottom wall 101. When the moving member 6 is pulled out of the tubular member 2, the magnetic member 4 is in turn moved away from the bottom wall 101 so as to release the attracted magnetic metal objects. Therefore, the magnetic metal objects can be removed and collected at a desired site with the use of the magnetic sweeper.

Since the tubular member 2 is not retractable, it is both expensive and inconvenient to pack, ship and store the magnetic sweeper of the prior art.

SUMMARY OF THE INVENTION

Therefore, the object of the present invention is to provide a magnetic sweeper which is retractable so as to overcome the aforesaid shortcomings of the prior art.

The retractable magnetic sweeper according to this invention includes a shell member, a retractable tubular member, a moving member, a connecting bar member, and a magnetic member. The shell member defines a receiving space. The retractable tubular member includes a lower tubular section connected to the shell member, and an upper tubular section mounted slidably on the lower tubular section. The moving member is mounted on the upper tubular section of the retractable tubular member. The connecting bar member is mounted axially within the retractable tubular member, and includes an operating end portion extending into the upper tubular section of the retractable tubular member and connected to the moving member, and a connecting end portion extending into the lower tubular section of the retractable tubular member. The magnetic member is mounted in the receiving space of the shell member, and is connected to the connecting end portion of the connecting bar member. The moving member is operable to move the magnetic member downward to an operative state, and upward to a non-operative state.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
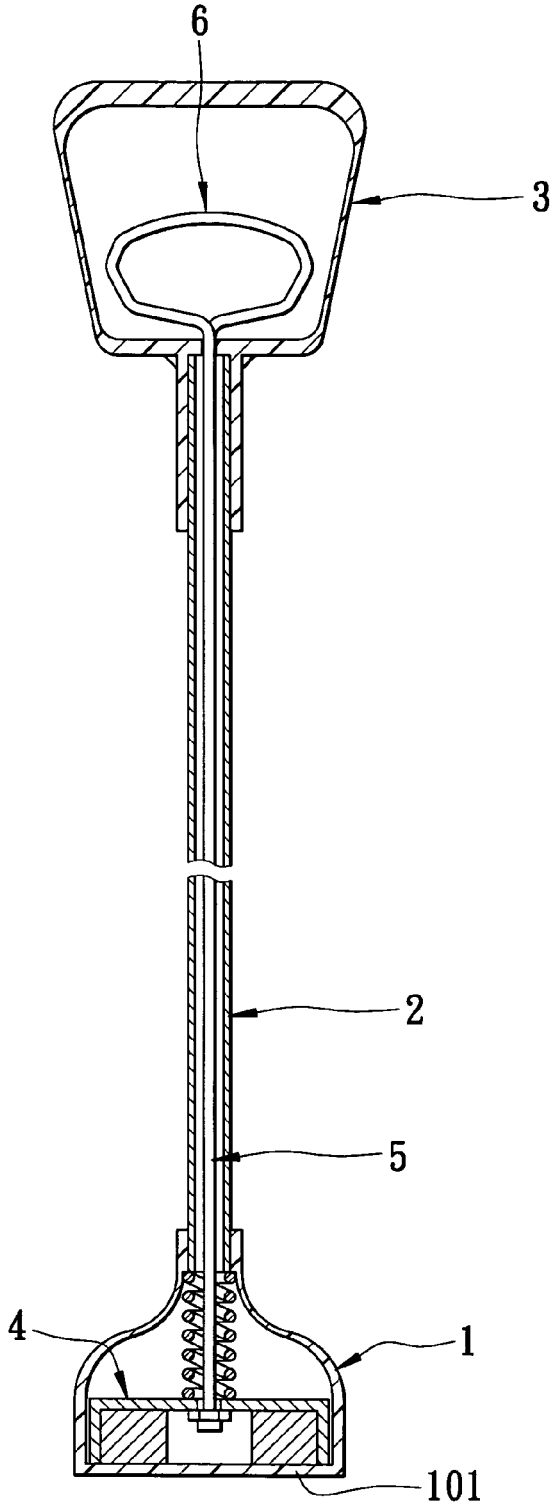
FIG. 1 PRIOR ART
FIG. 1 is a fragmentary sectional view of a conventional magnetic sweeper.
Figure 2:
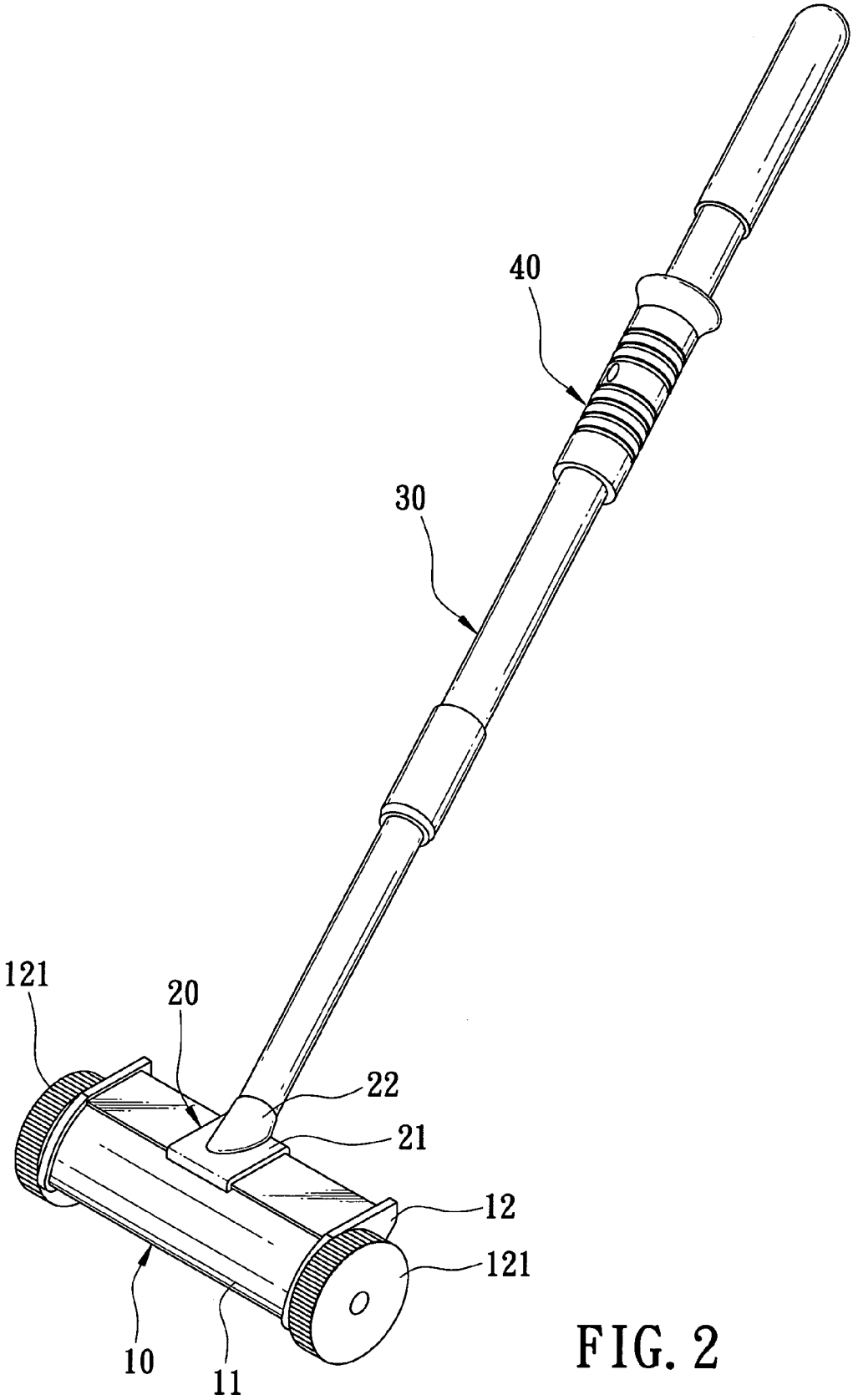
FIG. 2 is a perspective view of the first preferred embodiment of a retractable magnetic sweeper according to this invention.
Figure 3:
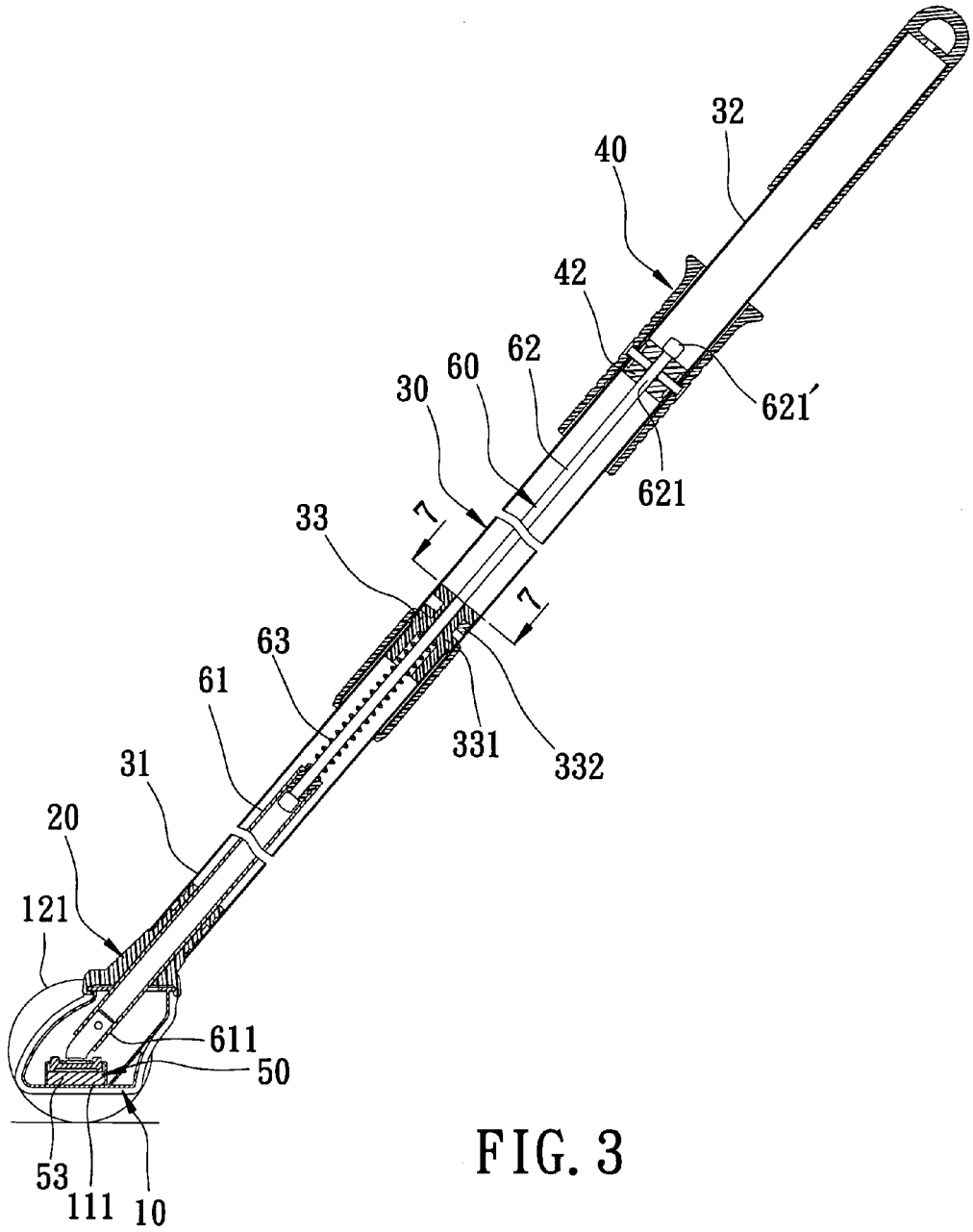
FIG. 3 is a sectional view of the first preferred embodiment.

Referring to FIGS. 2 and 3, the first preferred embodiment of a retractable magnetic sweeper according to this invention is shown to be used for attracting magnetic metal objects, such as nails, nuts, screws, springs, studs, clips, etc., and subsequently moving them to a desired site. The retractable magnetic sweeper includes a shell member 10, a connecting seat 20, a retractable tubular member 30, a moving member 40, a connecting bar member 60, and a magnetic member 50.

Figure 5:
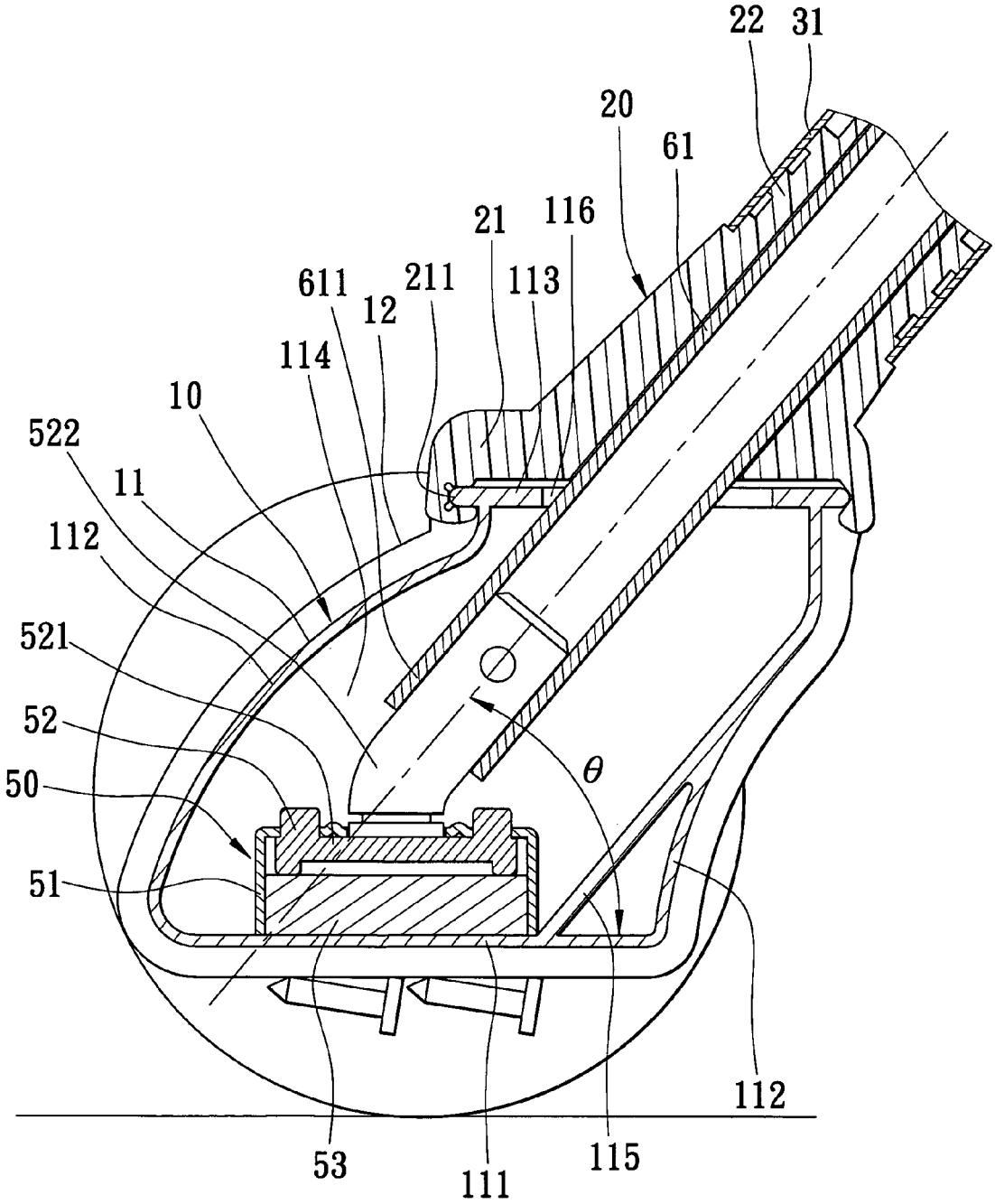
FIG. 5 is an enlarged fragmentary sectional view showing a shell member of the first preferred embodiment.

Referring further to FIG. 5, the shell member 10 is formed as a hollow body having a trapezial cross-section, and includes a bottom wall 111 extending below the magnetic member 50, a top portion 113 opposite to the bottom wall 111, and a plurality of side walls 11 extending between the bottom wall 111 and the top portion 113 so as to define a receiving space 114. The top portion 113 is provided with a hole 116. The side walls 11 include a pair of first side walls 12 opposite to each other, and a pair of second side walls 112 opposite to each other and each extending between the first side walls 12. The shell member 10 further includes a pair of wheels 121 attached to the first side walls 12, respectively, and a guiding wall 115 connected between the bottom wall 111 and one of the second side walls 112.

As shown in FIGS. 3 and 5, the connecting seat 20 is mounted between the shell member 10 and the retractable tubular member 30, and is disposed around the connecting bar member 60. The connecting seat 20 includes a cover 21 mounted on the shell member 10, and a connecting tube 22 extending upward from and inclining with respect to the cover 21. The connecting tube 22 is connected to the retractable tubular member 30. The cover 21 is formed with a groove 211 at the bottom thereof for engaging the top portion 113 of the shell member 10. The connecting tube 22 of the connecting seat 20 forms an angle smaller than 90 degrees relative to the bottom wall 111 of the shell member 10. In the preferred embodiment, the angle is about 50 degrees.

Figure 4:
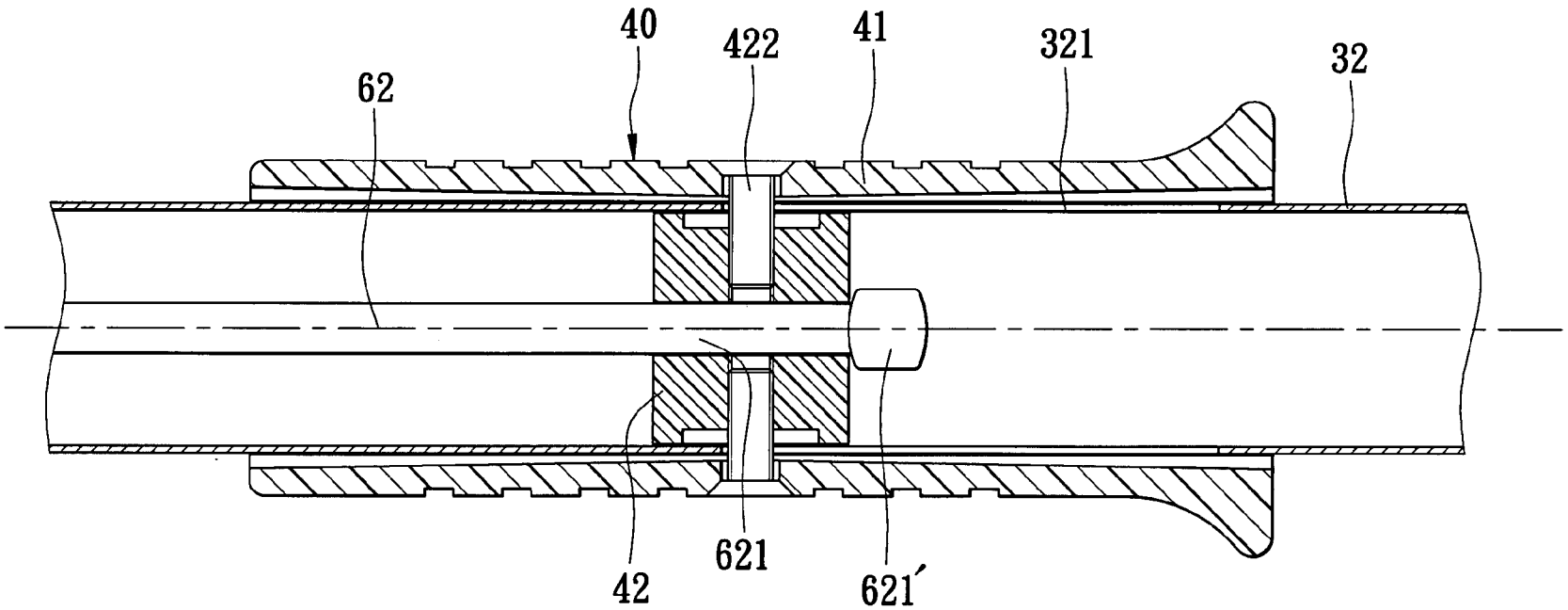
FIG. 4 is an enlarged fragmentary sectional view showing a moving member of the first preferred embodiment.

As shown in FIGS. 3, 4, and 5, the retractable tubular member 30 includes a lower tubular section 31 connected to the shell member 10 via the connecting seat 20, an upper tubular section 32 mounted slidably on the lower tubular section 31, and a positioning unit 33 mounted between the lower and upper tubular sections 31, 32 so as to lock the lower tubular section 31 against movement relative to the upper tubular section 32 after retraction of the upper tubular section 32 relative to the lower tubular section 31. The upper tubular section 32 has a pair of guiding slots 321 opposite to each other and extending axially along the upper tubular section 32.

Figure 6:
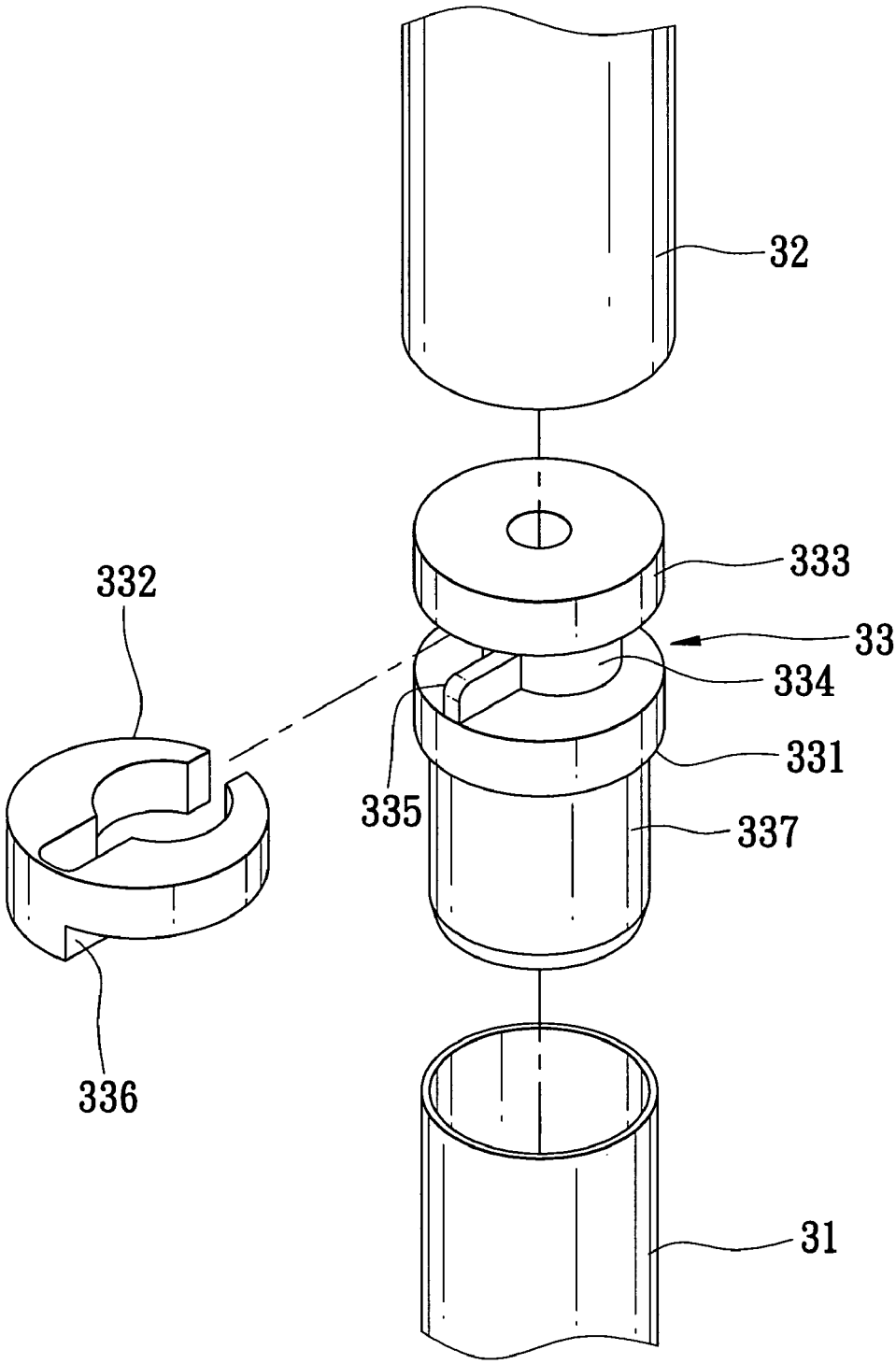
FIG. 6 is an exploded fragmentary perspective view showing a positioning unit of the first preferred embodiment.
Figure 7:
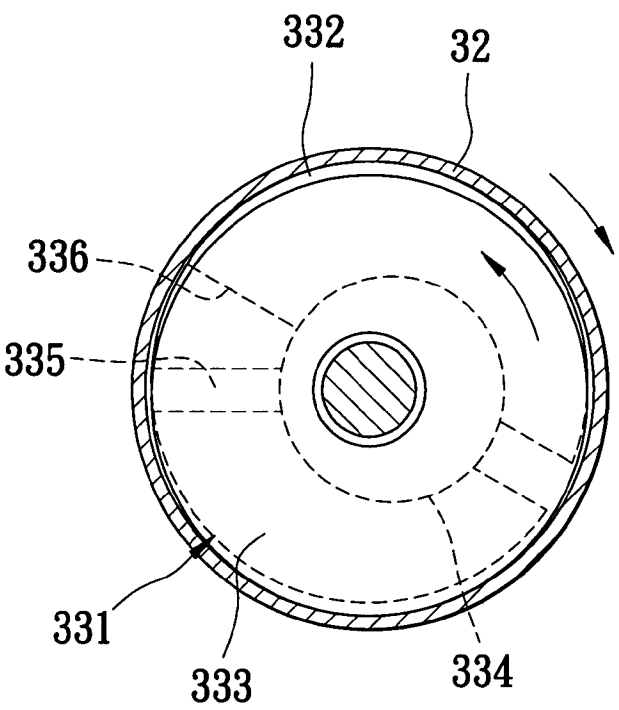
FIG. 7 is a sectional view taken along line 7—7 in FIG. 3, showing a protruding state of the positioning unit.

Referring to FIG. 6, the positioning unit 33 of the retractable tubular member 30 includes an eccentric coupler 331 fixed to the lower tubular section 31 and extending slidably into the upper tubular section 32, and an eccentric sliding block 332 mounted rotatably around the eccentric coupler 331 within the upper tubular section 32. The eccentric coupler 331 includes a first portion 333 extending slidably into the upper tubular section 32, a second portion 337 opposite and coaxial to the first portion 333 and fixed to the lower tubular section 31, an eccentric neck 334 mounted between the first and second portions 333, 337 and eccentric relative to the first portion 333, and a stopping block 335 extending radially from the eccentric neck 334. The eccentric sliding block 332 has a stepped portion 336 stopped by the stopping block 335 of the eccentric coupler 331. The eccentric sliding block 332 is rotatable about the eccentric neck 334 between a protruding position (best shown in FIG. 7), in which the eccentric sliding block 332 protrudes from the first portion 333 to be in tight fit with the upper tubular section 32, and a non-protruding position (best shown in FIG. 8), in which the eccentric sliding block 332 is aligned with the first portion 333 to be in loose fit with the upper tubular section 32.

Referring again to FIGS. 3 and 4, the moving member 40 is mounted on the upper tubular section 32 of the retractable tubular member 30. In this embodiment, the moving member 40 includes a hollow cylindrical member 41 sleeved around the upper tubular section 32, a positioning block 42 mounted inside the upper tubular section 32, and a pair of fastening elements 422 for fastening the positioning block 42 to the hollow cylindrical member 41 through the guiding slots 321.

As best shown in FIGS. 3, 4, and 5, the connecting bar member 60 is mounted axially within the retractable tubular member 30, and includes an operating end portion 621 extending into the upper tubular section 32 of the retractable tubular member 30 and connected to the positioning block 42 of the moving member 40, and a connecting end portion 611 extending into the lower tubular section 31 of the retractable tubular member 30. In this embodiment, the connecting bar member 60 further includes a lower bar section 61 having the connecting end portion 611 and connected to the magnetic member 50, an upper bar section 62 having the operating end portion 621 and connected to the lower bar section 61, and a resilient member 63 mounted around the upper bar section 62 between the lower bar section 61 and the eccentric coupler 331 of the positioning unit 33. The operating end portion 621 of the connecting bar member 60 extends through the positioning block 42 and has an enlarged head 621' abutting against the positioning block 42 of the moving member 40.

In addition, the magnetic member 50 is mounted in the receiving space 114 of the shell member 10, and is connected to the connecting end portion 611 of the connecting bar member 60. Preferably, the magnetic member 50 includes a base seat 51 in a form of a reverse U-shaped sectional configuration, a guiding adapter 52 having a base portion 521 fastened to the base seat 51 and a connecting tube 522 connected to the connecting end portion 611 of the connecting bar member 60, and a magnetic element 53 connected to the base portion 521 of the guiding adapter 52.

As shown in FIGS. 3 and 5, when the upper tubular section 32 of the retractable tubular member 30 is fully extended relative to the lower tubular section 31, the upper bar section 62 of the connecting bar member 60 is in turn extended relative to the lower bar section 61. At this time, the magnetic element 53 of the magnetic member 50 is moved to and biased against the bottom wall 111 of the shell member 10 due to the resilience of the resilient member 63 so as to dispose the magnetic member 50 at an operative state, in which the magnetic metal objects can be attracted by the magnetic member 50.

Figure 9:
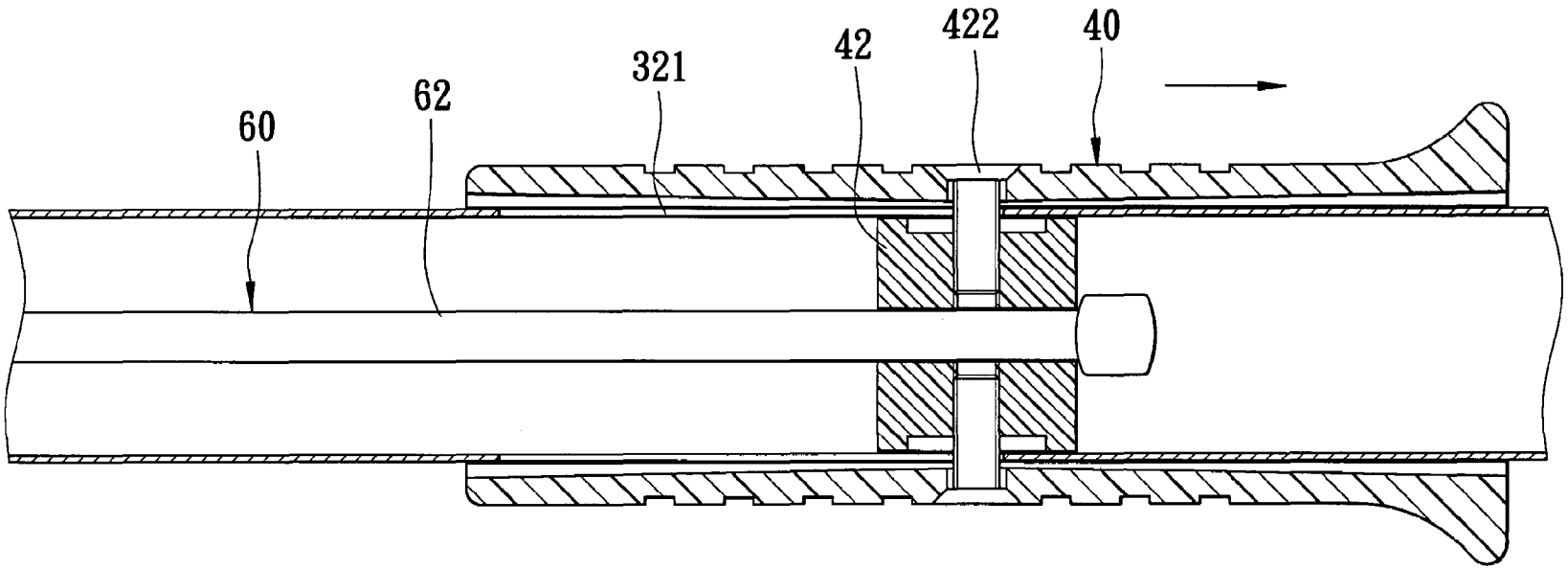
FIG. 9 is an enlarged fragmentary sectional view similar to FIG. 4, showing a sliding state of the moving member relative to an upper tubular section of a retractable tubular member of the first preferred embodiment.
Figure 10:
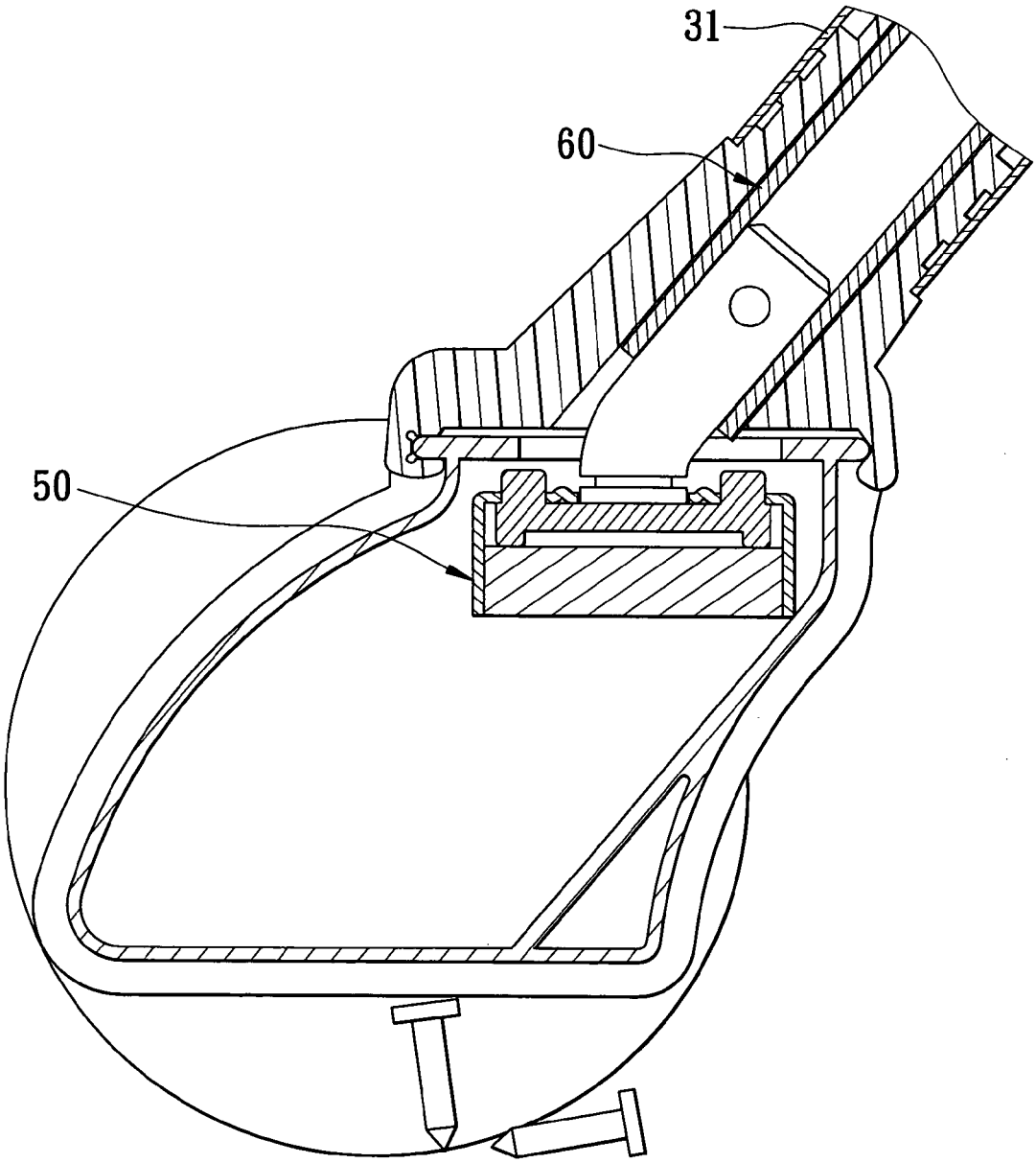
FIG. 10 is an enlarged fragmentary sectional view similar to FIG. 5, showing a non-operative state of a magnetic member of the first preferred embodiment.

Referring to FIGS. 9 and 10, after moving the attracted magnetic metal objects to a desired site, the moving member 40 is moved away from the lower tubular section 31 of the retractable tubular member 30, as shown by an arrow in FIG. 9. The fastening elements 422 are moved upward along the guiding slots 321, and the connecting bar member 60 and the magnetic member 50 are in turn moved upward by the positioning block 42 of the moving member 40 so as to dispose the magnetic member 50 at a non-operative state, in which the attracted magnetic metal objects can be released from the magnetic sweeper. When the moving member 40 is released by an operator, the moving member 40, the magnetic member 50, and the connecting bar member 60 are restored to the initial operative state due to the resilience of the resilient member 63.

Figure 8:
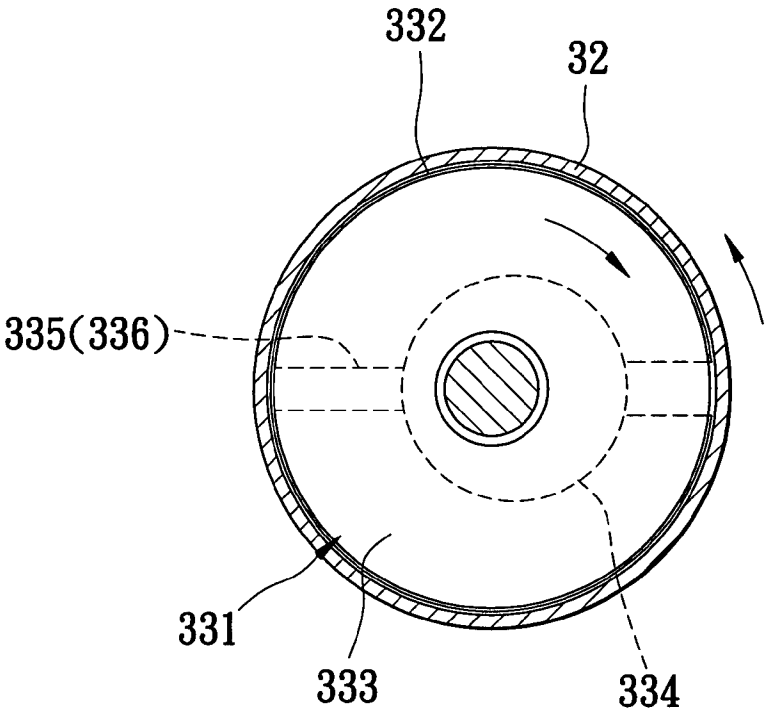
FIG. 8 is a sectional view similar to FIG. 7, but showing a non-protruding state of the positioning unit.
Figure 11:
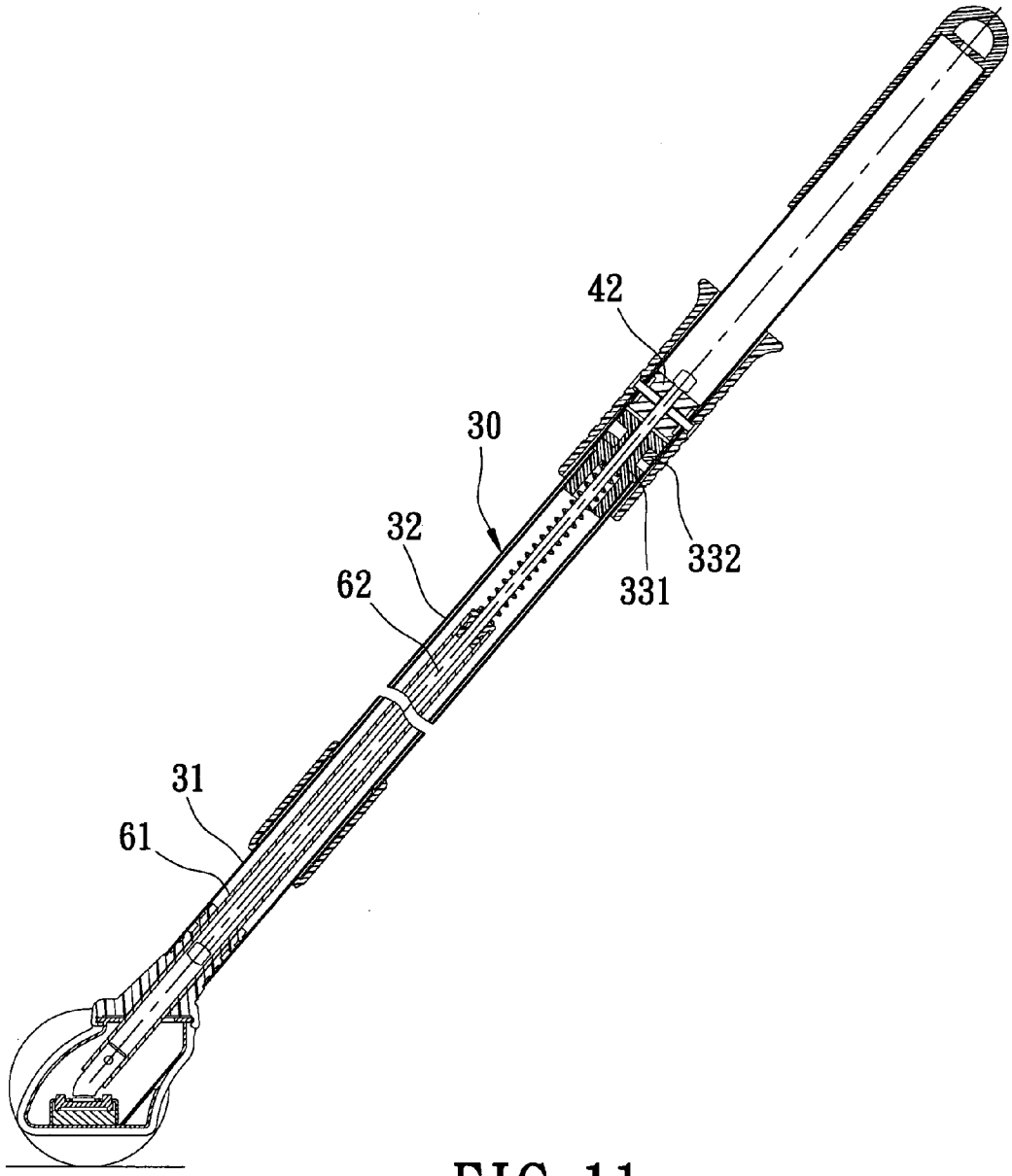
FIG. 11 is a sectional view of the first preferred embodiment in a retracted state.

Referring to FIGS. 8 and 11, when the upper and lower tubular sections 32, 31 of the retractable tubular member 30 are rotated relative to each other so as to rotate the eccentric sliding block 332 about the eccentric neck 334 to the non-protruding position, the upper tubular section 32 and the upper bar section 62 can be retracted toward the lower tubular section 31 and the lower bar section 61, respectively, until the positioning block 42 abuts against the eccentric coupler 331. Therefore, transport and storage of the retractable magnetic sweeper of this invention are easier as compared to the prior art.

Figure 12:
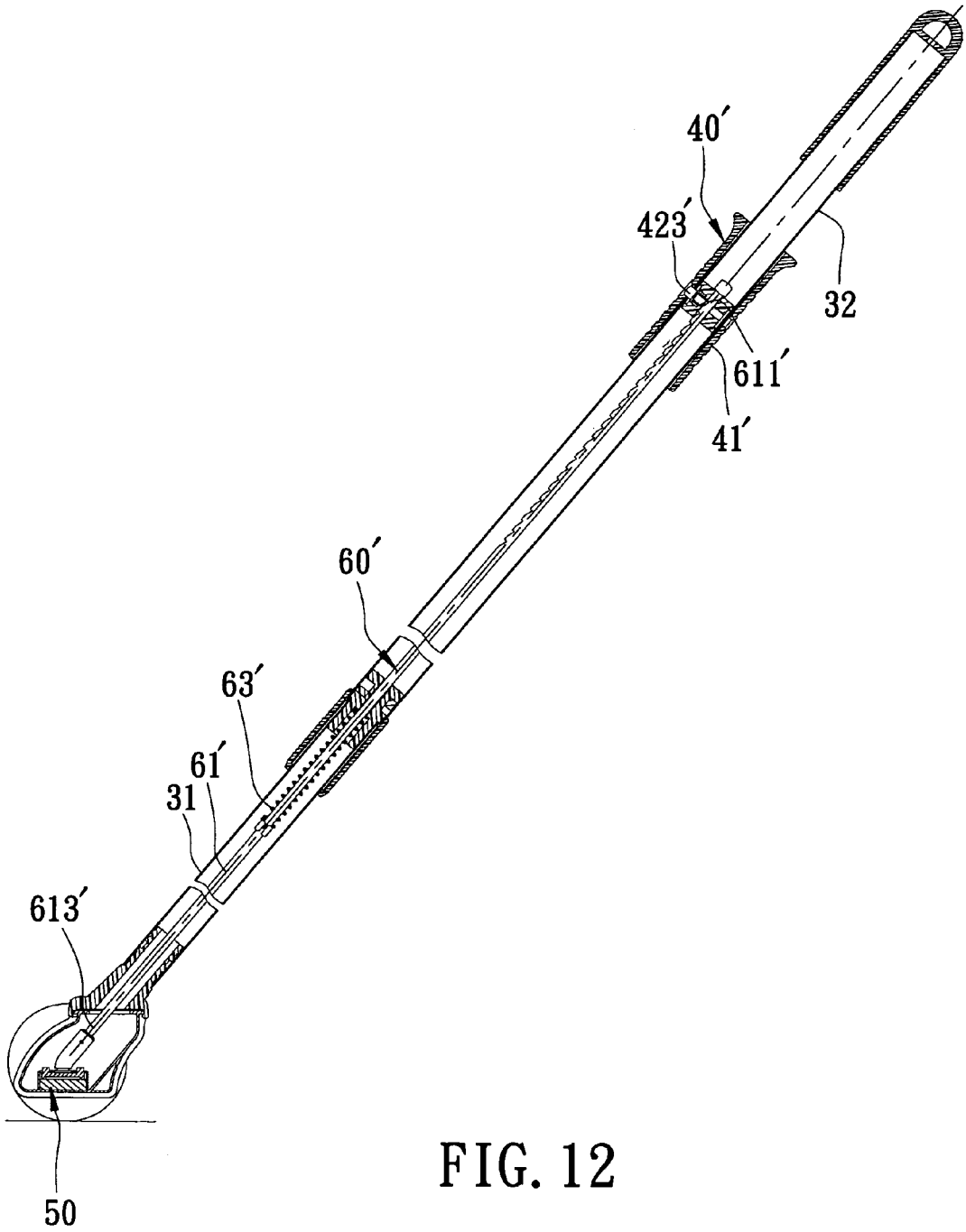
FIG. 12 is a sectional view of the second preferred embodiment of a retractable magnetic sweeper according to this invention.
Figure 14:
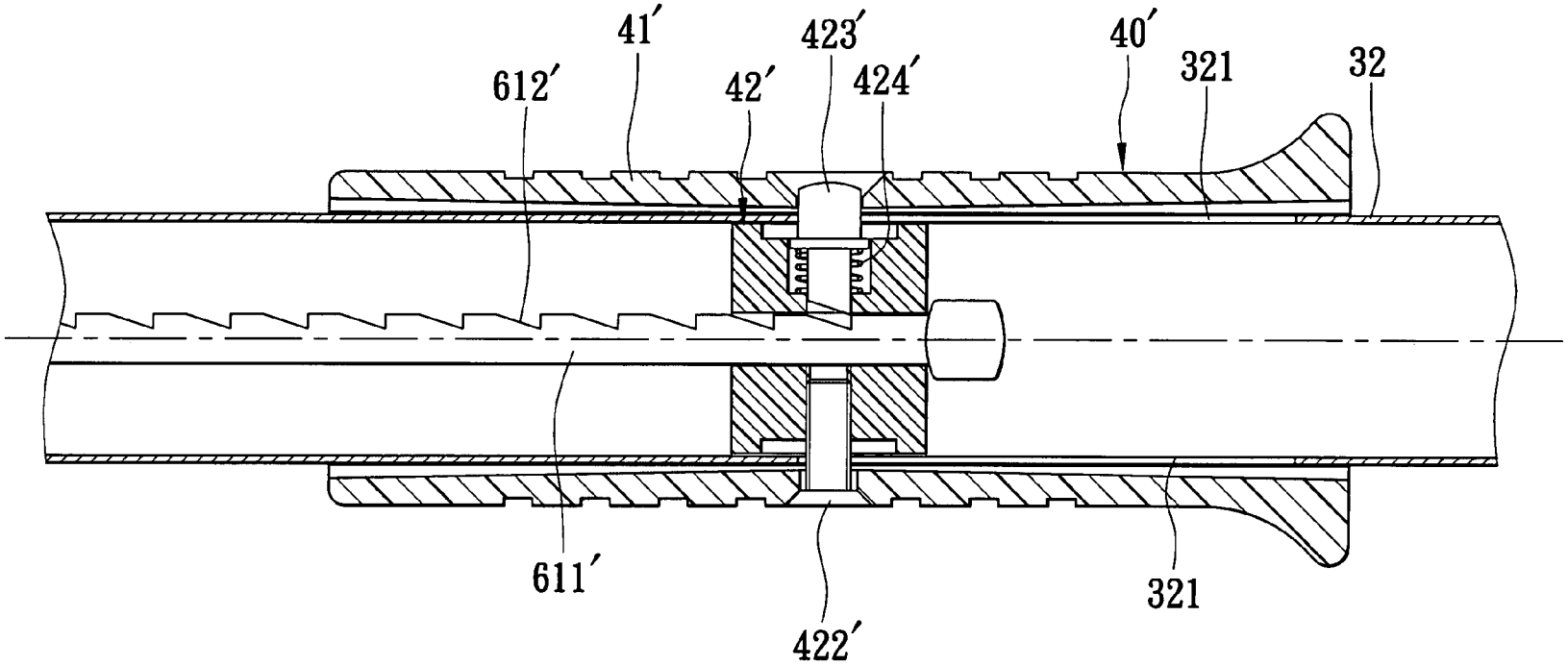
FIG. 14 is an enlarged fragmentary sectional view showing a moving member of the second preferred embodiment.

Referring to FIGS. 12 and 14, the second preferred embodiment of the retractable magnetic sweeper according to this invention is shown to be similar to the first preferred embodiment, except for the moving member 40' and the connecting bar member 60'. In this embodiment, the moving member 40' has a hollow cylindrical member 41' sleeved around the upper tubular section 32, a positioning block 42' mounted in the upper tubular section 32, a fastening element 422' for fastening the positioning block 42' to the cylindrical member 41' through one of the guiding slots 321, a pin 423' penetrating into the positioning block 42' through the other one of the guiding slots 321, and a resilient member 424' for biasing the pin 423' outwardly. The operating end portion 611' extends through the positioning block 42' and is formed with a series of ratchet teeth 612'. The pin 423' selectively engages one of the ratchet teeth 612'. The connecting bar member 60' includes a bar section 61' extending axially between the operating end portion 611' and the connecting end portion 613', and a resilient member 63' mounted around the bar section 61'.

Figure 15:
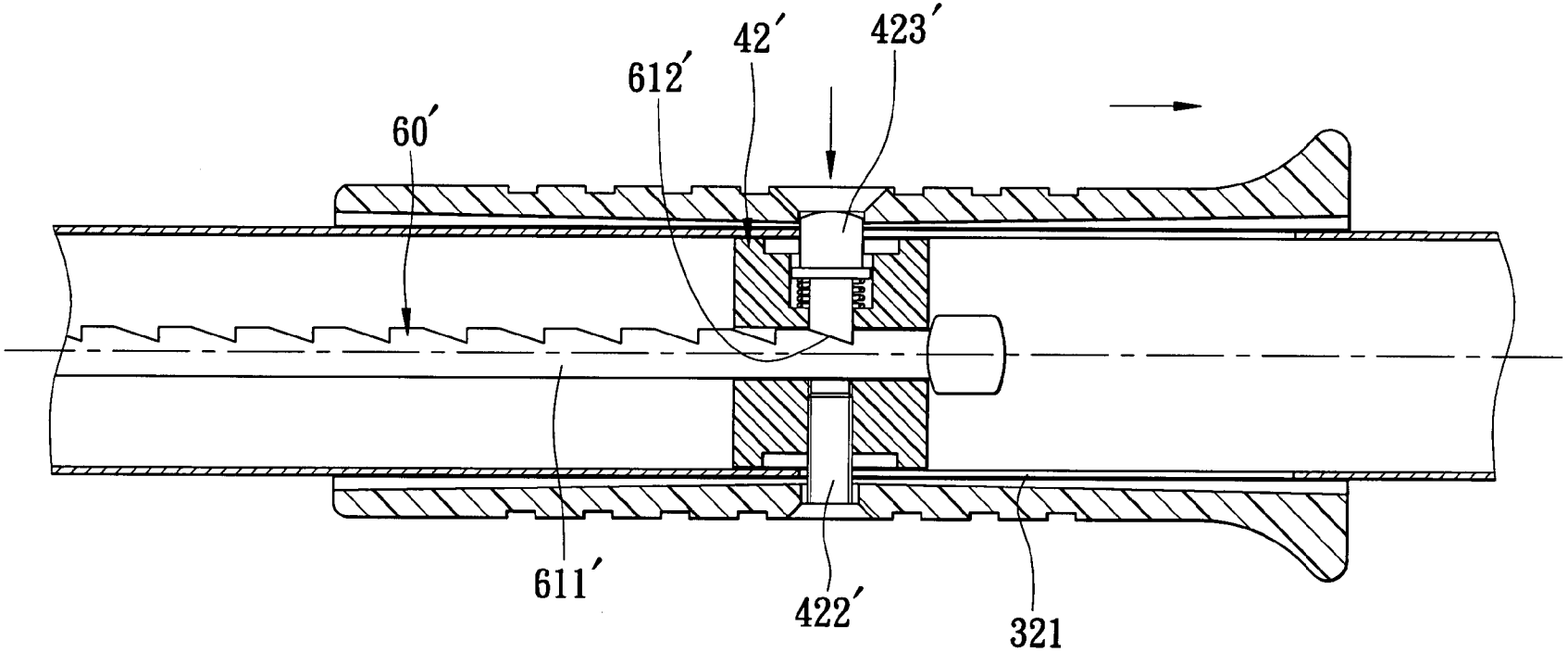
FIG. 15 is an enlarged fragmentary sectional view similar to FIG. 14 to show a pin engaging a ratchet tooth.
Figure 16:
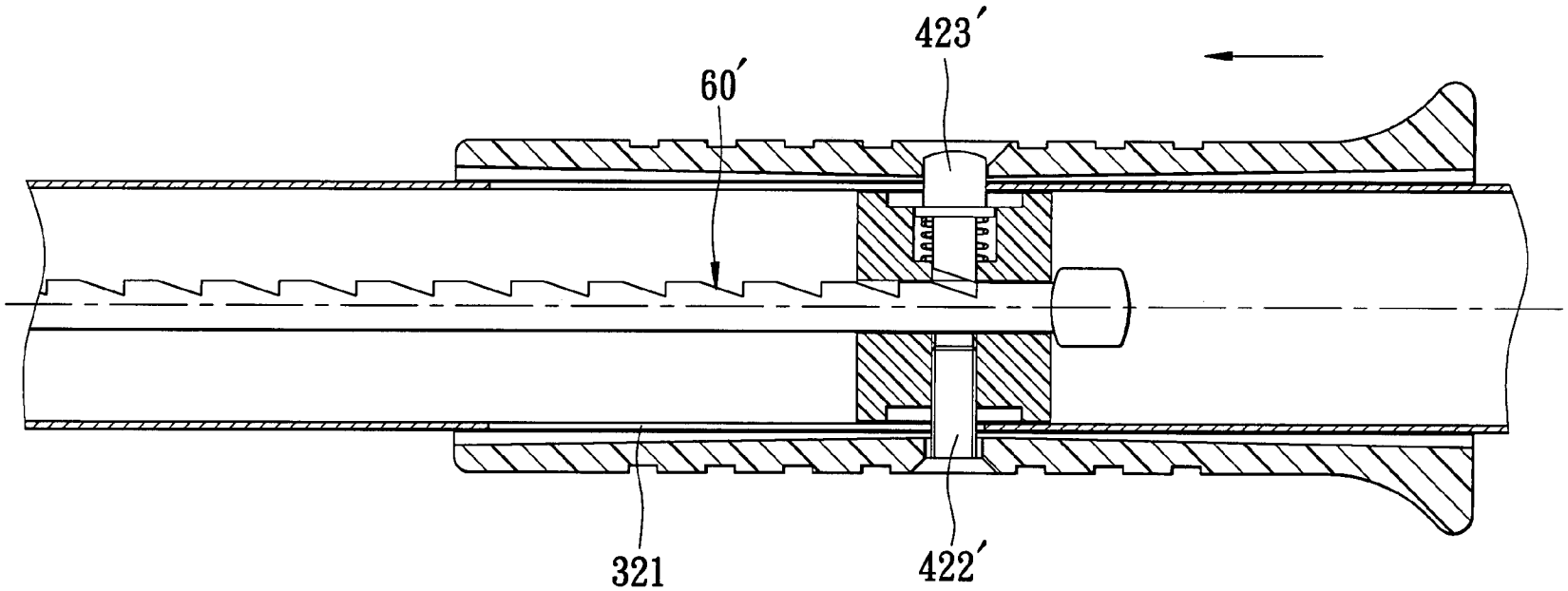
FIG. 16 is an enlarged fragmentary sectional view showing how a non-operative state of a magnetic member is achieved through a hollow cylindrical member of the moving member of the second preferred embodiment.

Referring to FIGS. 15 and 16, when the pin 423' is pushed to engage one of the ratchet teeth 612', the connecting bar member 60' can be moved axially in a direction indicated by an arrow in FIG. 15 to move in turn the magnetic member 50 to the non-operative state. When the pin 423' is released, the magnetic member 50 is restored to the initial operative state due to the resilience of the resilient member 63'.

Figure 13:
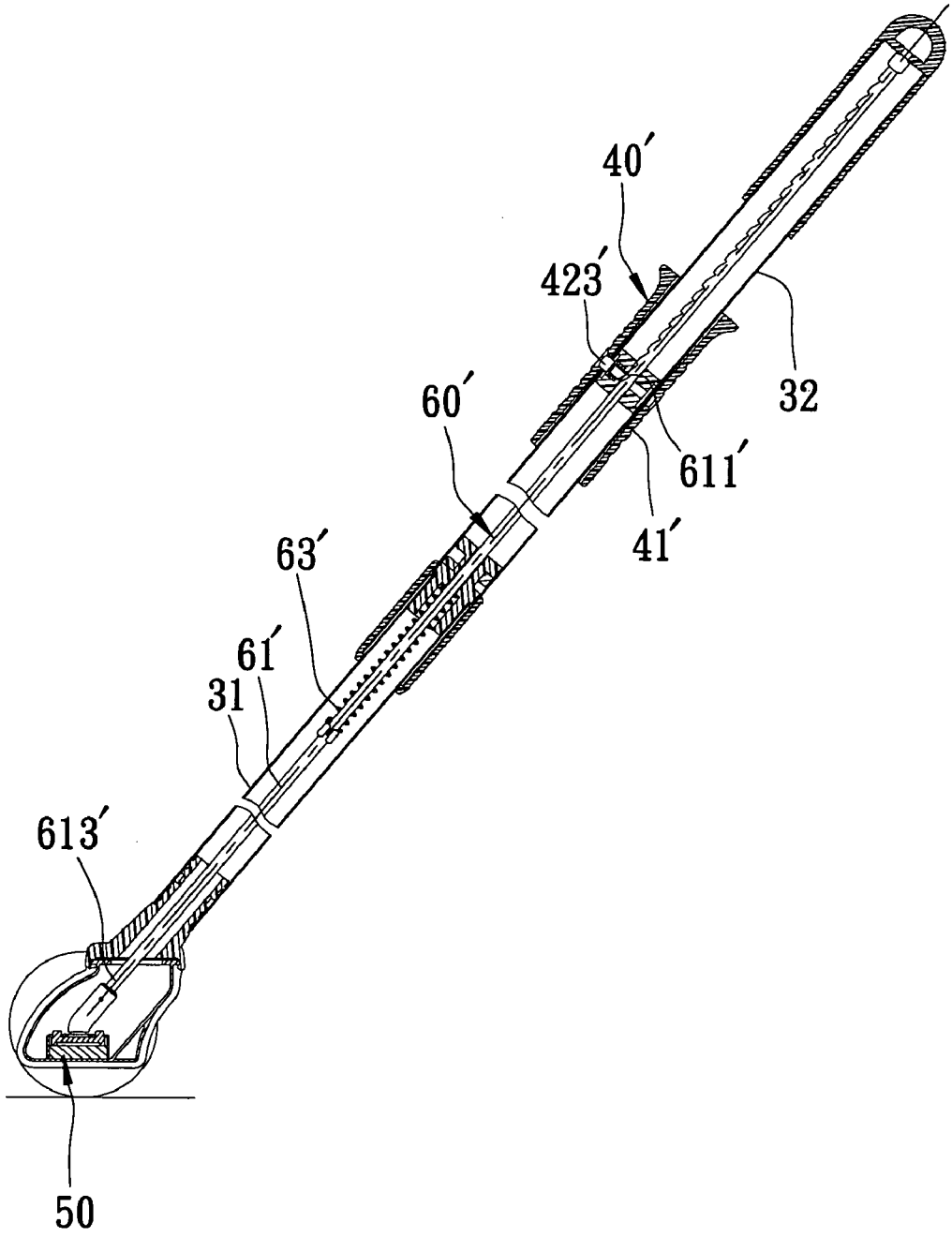
FIG. 13 is a sectional view of the second preferred embodiment in a retracted state.

Referring to FIG. 13, when the upper tubular section 32 is retracted toward the lower tubular section 31 until a top end of the upper tubular section 32 abuts against the operating end portion 611' of the connecting bar member 60', the magnetic member 50 can be moved between the operative and non-operative states in the manner described hereinabove.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A retractable magnetic sweeper, comprising:

a shell member defining a receiving space;

a retractable tubular member including a lower tubular section connected to said shell member, and an upper tubular section mounted slidably on said lower tubular section;

a moving member mounted on said upper tubular section of said retractable tubular member;

a connecting bar member mounted axially within said retractable tubular member, and including an operating end portion extending into said upper tubular section of said retractable tubular member and connected to said moving member, and a connecting end portion extending into said lower tubular section of said retractable tubular member; and a magnetic member mounted in said receiving space of said shell member, and connected to said connecting end portion of said connecting bar member;

wherein said moving member is operable to move said magnetic member downward to an operative state, and upward to a non-operative state, wherein said shell member includes a bottom wall extending below said magnetic member, a top portion opposite to said bottom wall, a plurality of side walls extending between said bottom wall and said top portion, and at least one wheel attached to one of said side walls, wherein said shell member is formed as a hollow body having a trapezial cross-section, said side walls including a pair of first side walls opposite to each other, and a pair of second side walls opposite to each other and each extending between said first side walls, and wherein said shell member further includes a guiding wall connected between said bottom wall and one of said second side walls.

2. The retractable magnetic sweeper as claimed in claim 1, wherein a pair of said wheels are mounted on said first side walls.

3. A retractable magnetic sweeper, comprising:

a shell member defining a receiving space;

a retractable tubular member including a lower tubular section connected to said shell member, and an upper tubular section mounted slidably on said lower tubular section;

a moving member mounted on said upper tubular section of said retractable tubular member;

a connecting bar member mounted axially within said retractable tubular member, and including an operating end portion extending into said upper tubular section of said retractable tubular member and connected to said moving member, and a connecting end portion extending into said lower tubular section of said retractable tubular member;

a magnetic member mounted in said receiving space of said shell member, and connected to said connecting end portion of said connecting bar member; and a connecting seat mounted between said shell member and said retractable tubular member, and around said connecting bar member, said connecting seat including a cover mounted on said shell member, and a connecting tube extending upward from and inclining with respect to said cover, said connecting tube being connected to said lower tubular section of said retractable tubular member, wherein said moving member is operable to move said magnetic member downward to an operative state, and upward to a non-operative state.

4. The retractable magnetic sweeper as claimed in claim 3, wherein said connecting tube of said connecting seat forms an angle smaller than 90 degrees relative to said bottom wall of said shell member.

5. A retractable magnetic sweeper, comprising:

a shell member defining a receiving space;

a retractable tubular member including a lower tubular section connected to said shell member, and an upper tubular section mounted slidably on said lower tubular section;

a moving member mounted on said upper tubular section of said retractable tubular member;

a connecting bar member mounted axially within said retractable tubular member, and including an operating end portion extending into said upper tubular section of said retractable tubular member and connected to said moving member, and a connecting end portion extending into said lower tubular section of said retractable tubular member; and a magnetic member mounted in said receiving space of said shell member, and connected to said connecting end portion of said connecting bar member;

wherein said moving member is operable to move said magnetic member downward to an operative state, and upward to a non-operative state, and wherein said retractable tubular member further includes a positioning unit mounted between said lower and upper tubular sections so as to lock said lower tubular section against movement relative to said upper tubular section after retraction of said upper tubular section relative to said lower tubular section.

6. The retractable magnetic sweeper as claimed in claim 5, wherein said positioning unit of said retractable tubular member includes an eccentric coupler fixed to said lower tubular section and extending slidably into said upper tubular section, and an eccentric sliding block mounted rotatably around said eccentric coupler within said upper tubular section.

7. The retractable magnetic sweeper as claimed in claim 6, wherein said eccentric coupler includes a first portion extending slidably into said upper tubular section, a second portion opposite and coaxial to said first portion and fixed to said lower tubular section, an eccentric neck mounted between said first and second portions and eccentric relative to said first portion, and a stopping block extending radially from said eccentric neck, said eccentric sliding block having a stepped portion stopped by said stopping block of said eccentric coupler, said eccentric sliding block being rotatable about said eccentric neck between a protruding position, in which said eccentric sliding block protrudes from said first portion to be in tight fit with said upper tubular section, and a non-protruding position, in which said eccentric sliding block is aligned with said first portion to be in loose fit with said upper tubular section.

8. The retractable magnetic sweeper as claimed in claim 6, wherein said upper tubular section has at least one guiding slot extending axially along said upper tubular section.

9. The retractable magnetic sweeper as claimed in claim 8, wherein said moving member includes a hollow cylindrical member sleeved around said upper tubular section, a positioning block mounted inside said upper tubular section, and at least one fastening element for fastening said positioning block to said hollow cylindrical member through said guiding slot.

10. The retractable magnetic sweeper as claimed in claim 9, wherein said operating end portion of said connecting bar member is connected to said positioning block of said moving member.

11. The retractable magnetic sweeper as claimed in claim 8, wherein said connecting bar member further includes a lower bar section having said connecting end portion and connected to said magnetic member, and an upper bar section having said operating end portion and connected to said lower bar section.

12. The retractable magnetic sweeper as claimed in claim 11, wherein said connecting bar member further includes a resilient member mounted around said upper bar section between said lower bar section and said eccentric coupler of said positioning unit.

13. The retractable magnetic sweeper as claimed in claim 9, wherein said operating end portion of said connecting bar member extends through said positioning block and has an enlarged head abutting against said positioning block of said moving member.

14. The retractable magnetic sweeper as claimed in claim 8, wherein said upper tubular section of said retractable tubular member has a pair of said guiding slots opposite to each other, said moving member having a hollow cylindrical member sleeved around said upper tubular section, a positioning block mounted in said upper tubular section, a fastening element for fastening said positioning block to said cylindrical member through one of said guiding slots, a pin penetrating into said positioning block through the other one of said guiding slots, and a resilient member for biasing said pin outwardly.

15. The retractable magnetic sweeper as claimed in claim 14, wherein said operating end portion extends through said positioning block and is formed with a series of ratchet teeth, said pin selectively engaging one of said ratchet teeth.

16. The retractable magnetic sweeper as claimed in claim 14, wherein said connecting bar member further includes a bar section extending axially between said operating end portion and said connecting end portion, and a second resilient member mounted around said bar section.

17. A retractable magnetic sweeper, comprising:

a shell member defining a receiving space;

a retractable tubular member including a lower tubular section connected to said shell member, and an upper tubular section mounted slidably on said lower tubular section;

a moving member mounted on said upper tubular section of said retractable tubular member;

a connecting bar member mounted axially within said retractable tubular member, and including an operating end portion extending into said upper tubular section of said retractable tubular member and connected to said moving member, and a connecting end portion extending into said lower tubular section of said retractable tubular member; and a magnetic member mounted in said receiving space of said shell member, and connected to said connecting end portion of said connecting bar member;

wherein said moving member is operable to move said magnetic member downward to an operative state, and upward to a non-operative state, and wherein said magnetic member includes a base seat in a form of a reverse U-shaped sectional configuration, a guiding adapter having a base portion fastened to said base seat and a connecting tube connected to said connecting end portion of said connecting bar member, and a magnetic element connected to said base portion of said guiding adapter.

* * * * *